US006431053B1

(12) United States Patent
Strikis et al.

(10) Patent No.: US 6,431,053 B1
(45) Date of Patent: Aug. 13, 2002

(54) PISTON FOR A SWASHPLATE RECIPROCATING COMPRESSOR

(75) Inventors: Guntis Viktors Strikis, Belleville; Shane A. Harte; Srinivas S. Pitla, both of Farmington Hills; Vipen Khetarpal, Novi, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/802,074

(22) Filed: Mar. 8, 2001

(51) Int. Cl.[7] ..... F01B 31/10
(52) U.S. Cl. ..... 92/158
(58) Field of Search ..... 92/158, 159, 160, 92/154, 172, 181 R

(56) References Cited

U.S. PATENT DOCUMENTS

| | | | | | |
|---|---|---|---|---|---|
| 1,460,537 | A | * | 7/1923 | Dewar | 92/158 |
| 1,487,965 | A | | 3/1924 | Michell | |
| 1,528,817 | A | * | 3/1925 | Dinnes | 92/160 |
| 1,947,818 | A | * | 2/1934 | White | 92/181 R X |
| 2,147,956 | A | * | 2/1939 | Alexandrescu | 92/160 |
| 2,197,942 | A | * | 4/1940 | Over | 92/160 |
| 2,300,009 | A | | 10/1942 | Rose | |
| 3,061,175 | A | * | 10/1962 | Schmidt | 92/158 |
| 3,153,987 | A | | 10/1964 | Thoma | |
| 4,522,112 | A | | 6/1985 | Nomura | |
| 5,174,728 | A | * | 12/1992 | Kimura et al. | 92/159 X |
| 5,816,134 | A | | 10/1998 | Takenaka et al. | |
| 5,943,943 | A | | 8/1999 | Arai | |
| 5,988,041 | A | | 11/1999 | Hiramatsu et al. | |

* cited by examiner

*Primary Examiner*—John E. Ryznic
(74) *Attorney, Agent, or Firm*—Brinks Hofer Gilson & Lione

(57) ABSTRACT

The present invention relates to a piston for use in a swashplate type compressor. The piston includes a void in the exterior surface of the head region that is positioned at a distance from a region that receives a side load during operation of the compressor. In preferred embodiments, the void comprises a helical groove that extends along a path parallel to the region receiving the side load, and a recess or depression positioned adjacent the region receiving the side load.

21 Claims, 5 Drawing Sheets

PISTON FOR A SWASHPLATE RECIPROCATING COMPRESSOR

FIELD OF THE INVENTION

Swashplate compressors use a swashplate disposed on a shaft at an angle to translate rotational movement of the shaft into linear movement of a piston. The piston movement allows for compression of a gas within the cylinder bore. The pistons of these compressors frequently include grooves on their surface for facilitating the movement of lubricating oil suspended in the gas to the moving parts of the compressor. A side load can be exerted on the piston in these compressors adding stress to the piston. The present invention provides pistons having one or more grooves and/or recesses optimally positioned around the region that receives the side load, thereby providing the ability to move lubricating oil to the moving parts of the compressor without compromising the surface that receives the side load

BRIEF DESCRIPTION OF PRIOR ART SWASHPLATE TYPE COMPRESSOR

Figure 1:
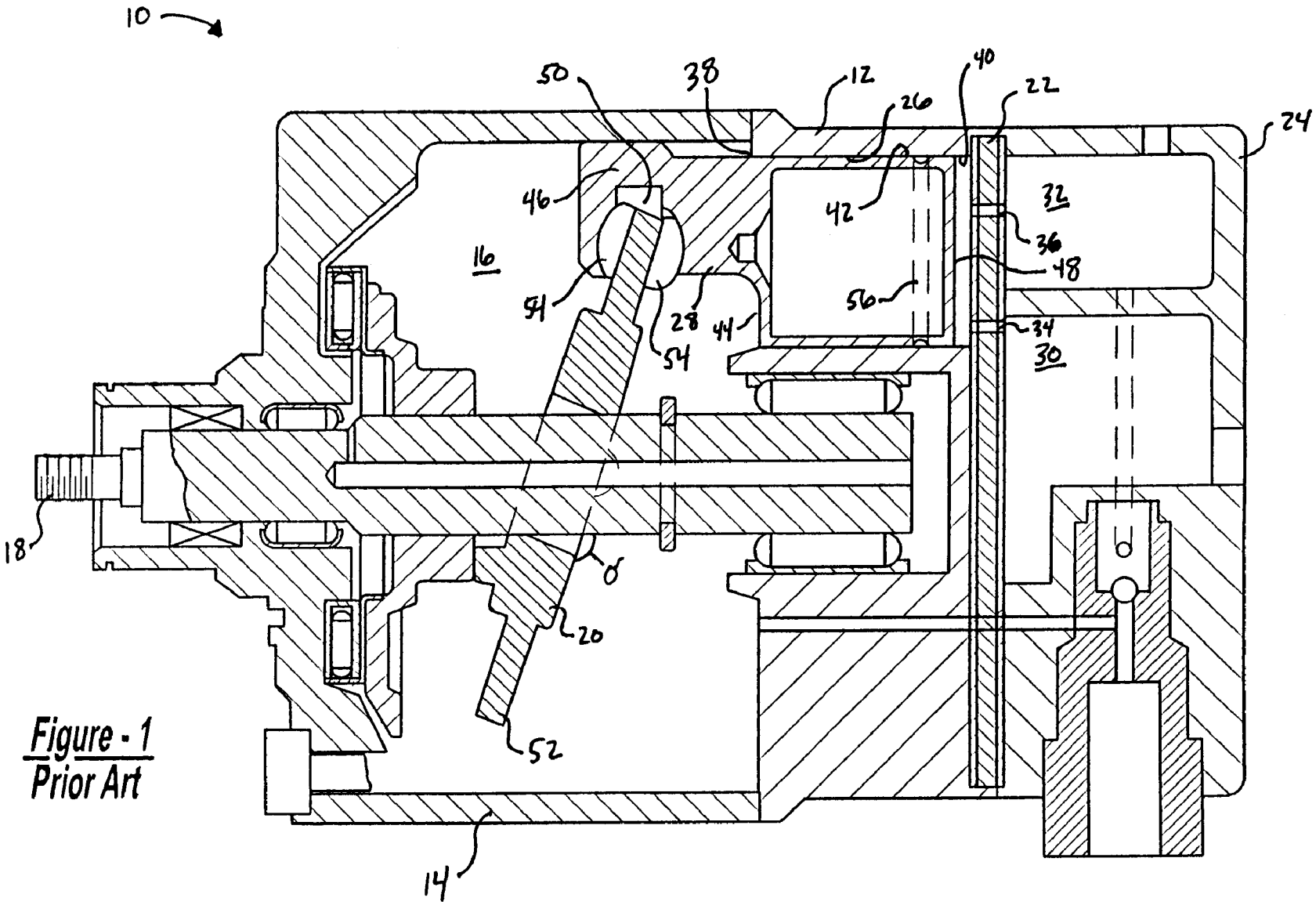
Figure - 1 Prior Art
FIG. 1 is a cross-sectional view of a prior art swashplate type compressor.

FIG. 1 illustrates a swashplate type compressor, generally indicated in the drawings as reference 10. The compressor 10 is known in the art and will not be described in detail herein. Briefly, the compressor 10 includes a cylinder block 12, a housing 14 that defines a crank chamber 16, a drive shaft 18, a swashplate 20, a valve plate 22, a rear housing 24, at least one cylinder bore 26, and at least one piston 28. The rear housing 24 defines a suction chamber 30 and a discharge chamber 32, and the valve plate 22 defines a suction port 34 and a discharge port 36. The drive shaft 18 is supported by the housing 14 such that a portion of the drive shaft 18 is disposed within the crank chamber 16. The swashplate 20 is fixedly attached to the drive shaft 18 and is wholly contained within the crank chamber 16. The swashplate 20 is mounted on the drive shaft 18 such that it is tilted away from a plane perpendicular to the longitudinal axis of the drive shaft 18. The degree to which the swashplate 20 is tilted away from the plane perpendicular to the longitudinal axis of the drive shaft 18 is indicated in the drawing as angle $\sigma$.

The cylinder block 12 defines the cylinder bore 26. The piston 28 is disposed within the cylinder bore 26 such that the piston 28 can slide in and out of the bore 26. This slideable movement of the piston 28 is possible, at least in part, due to the presence of a narrow gap 38 between the interior surface 40 of the cylinder block 12 in the cylinder bore 26 and the exterior surface 42 of the piston 28.

Figure 2:
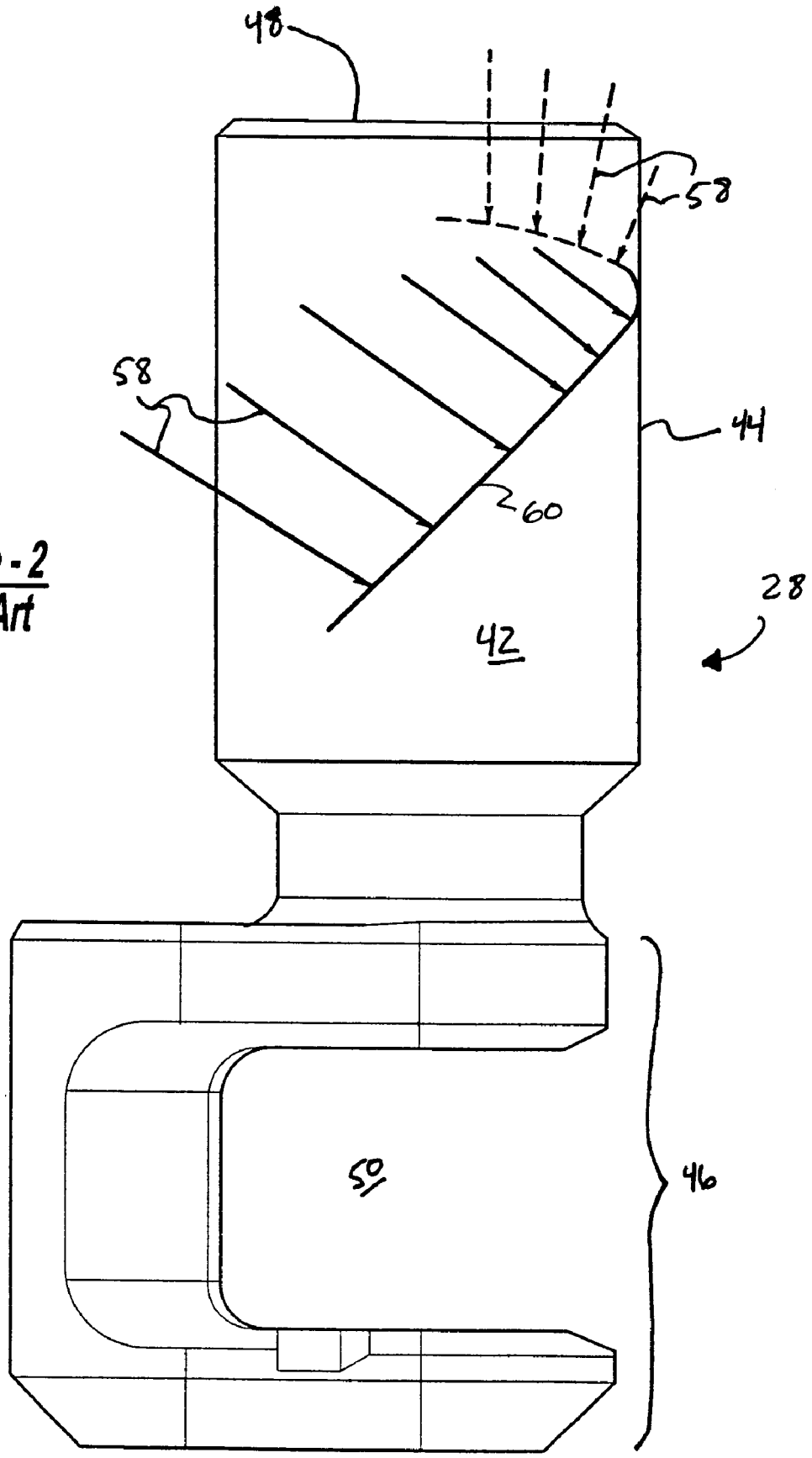
Figure - 2 Prior Art
FIG. 2 is a perspective view of a prior art piston showing the side-loading region.

As best illustrated in FIG. 2, the piston 28 of the compressor shown in FIG. 1 includes a head region 44 and a swashplate engaging region 46. The head region 44 is preferably a solid portion having a cross-section slightly smaller than that of the cylinder bore 26. The head region 44 provides the end surface 48 that compresses gas within the cylinder bore 26 as the piston 28 reciprocates. The swashplate engaging region 46 is located opposite the head region 44 and preferably defines a recess 50 capable of receiving at least the periphery 52 of the swashplate 20 (shown in FIG. 1). Shoes 54 may be seated in the swashplate engaging region 46 and about the swashplate 20. The engagement of the swashplate 20 by the piston 28 at the swashplate engaging region 46 affects the translation of rotary movement of the shaft 18 and attached swashplate 20 to linear reciprocating movement of the piston 28 within the cylinder bore 26, thereby enabling compression within the cylinder bore 26.

Some swashplate compressors utilize blowby gas to lubricate parts in the crank chamber 16. Blowby gas is the refrigerant gas being compressed that leaks into the crank chamber 16 through the gap 38 between the cylinder block 12 and the piston 28. Lubricating oil is suspended in the blowby gas, thereby constituting a mist, and serves as the lubricant. The amount of blowby gas, and therefore the amount of lubricant, that ultimately reaches the crank chamber 16 by this route is dependent, at least in part, on the size of the gap 38.

If movement of blowby gas is not desired, the piston 28 can include one or more grooves 56, as shown in FIG. 1, that serve to store oil and to seal the gap 38. Typically, the groove 56 comprises an annular groove 56, in or near the head region 44 of the piston 28. Lubricating oil adheres to the surface of the cylinder block 12 during operation of the compressor 10 and the annular groove 56 collects the oil as the piston 28 reciprocates within the cylinder bore 26. During the stroke of the piston 28, the annular groove 56 may be exposed to the crank chamber 16 and releases the collected oil to the parts therein, including the swashplate 20 and shoes 54. Thus, grooves 56 in the exterior surface 42 of the piston 28 can also provide a mechanism to facilitate the movement of lubricating oil to the crank chamber 16 without needing to increase the size of the gap 38.

Figure 3:
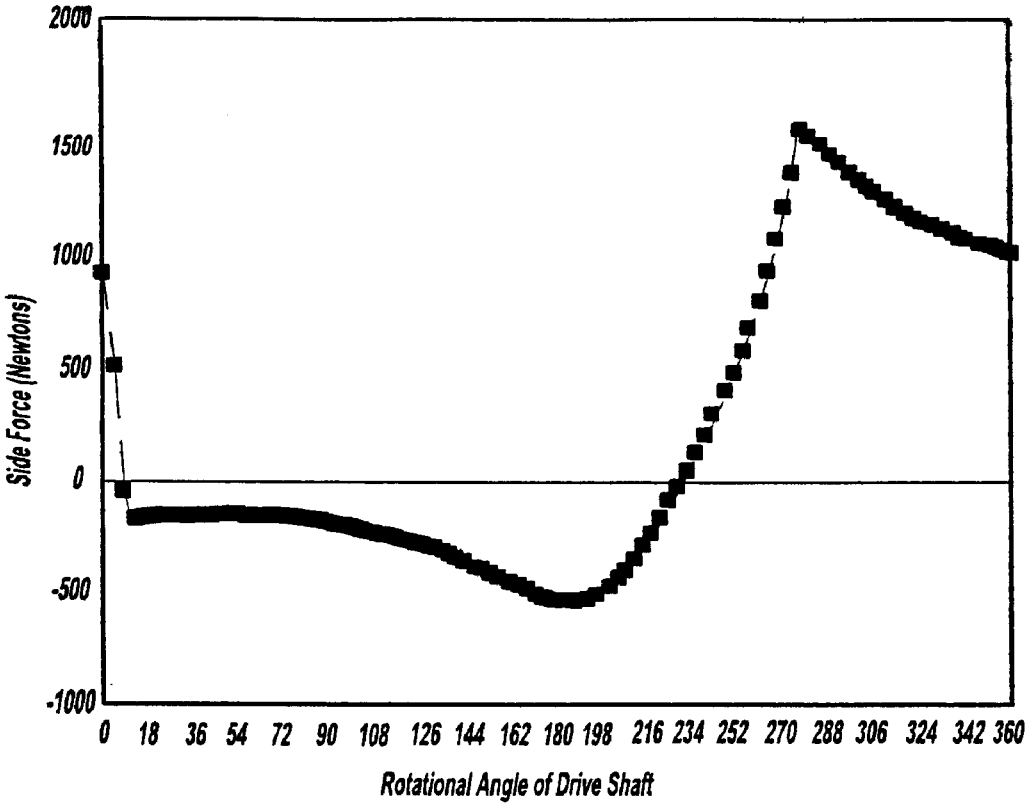
Figure - 3 Prior Art
FIG. 3 is a graph showing the relationship between the location of a prior art piston in its stroke and the level and location of the side load acting on the piston.
Figure 3:
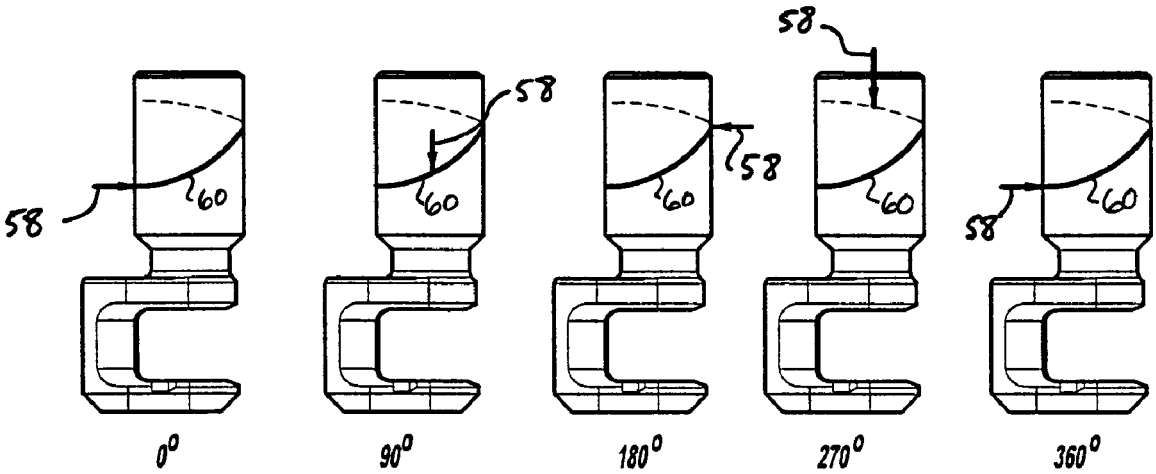
Figure - 3 Prior Art

When adding a groove 56 to the surface 42 of the piston 28, a side load 58 experienced by the piston 28 must be taken into consideration. A side load 58 for a particular piston is illustrated as a series of force lines in FIG. 2. The side load 58 refers to the reaction force from the interior surface 40 of the cylinder block 12 received by the piston 28. The reaction force is produced by a compression force and the inertial force of the piston 28. Due to the reciprocating action of the piston 28, the position at which the piston 28 receives the side load 58 varies as the piston 28 moves in and out of the cylinder bore 26. That is, as the piston 28 moves between its top dead center and bottom dead center positions, the side load is exerted on a varying region 60 of the exterior surface 42 of the piston 28. As shown in FIG. 2, the region 60 has a center line. A side load 58 is described in greater detail in U.S. Pat. No. 5,816,134 to Takenaka et al., for "A COMPRESSOR PISTON AND PISTON TYPE COMPRESSOR" which is hereby incorporated by reference in its entirety. FIG. 3 is a graph illustrating both the extent of the side load 58 and the location of the region 60 that receives the load 58 throughout a compression stroke of the piston 28. As shown in FIG. 2, over the course of the compression stroke, a helical region 60 on the exterior surface 42 of the piston 28 receives the side load 58.

It will be appreciated that the side load region varies in size and position for individual pistons. Furthermore, the size and location of the region, and consequently the center line, will depend on numerous factors, including the amount of pressure acting on the head region of the piston due to compression and expansion of gas in the cylinder bore; the angle of the swashplate relative to the longitudinal axis of the piston; the position of the piston within the bore; the relative positions of the start of the cylinder bore and the top of the piston, and the center of the shoes relative to the bottom of the piston; acceleration forces; friction within the bore; friction between the swashplate and shoes; friction between the shoes and piston; and gravity. Thus practicing the present invention, the side load region must be determined based on these factors for a particular piston.

DETAILED DESCRIPTION OF PREFERRED EMBODIMENTS OF THE INVENTION

The following description of three preferred embodiments of the present invention is not intended to limit the scope of the invention in any manner. The preferred embodiments are merely examples of particular pistons incorporating the present invention and are intended to enable any person skilled in the relevant art to make and use the invention.

Figure 4:
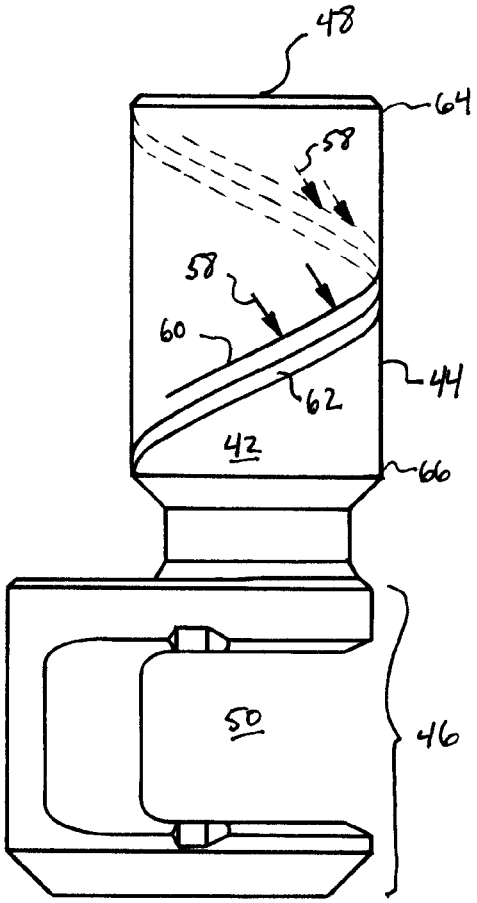
FIG. 4 is a perspective view of a piston incorporating a first preferred embodiment of the present invention.

The present invention provides a piston with a groove or recess that is positioned away from the side-loading region of the piston. In a first preferred embodiment, a helical groove 62 is located on the exterior surface of the piston. The helical configuration allows the groove 62 to be longer than a groove with a linear configuration. As illustrated in FIG. 4, the helical groove 62 is located at a position away from the side-loading region of the piston. Accordingly, it is preferred that the helical groove 62 extend along a path parallel to the side loading region 60, thereby ensuring that the groove 62 does not traverse the side loading region 60. This assures that the groove 62 does not reduce the area of the exterior surface available for receiving the side load, i.e., the side-loading region 60. Alternatively, the groove 62 can be positioned at an angle to the side-loading region 60, so long as it does not intersect the region 60.

To ensure that the presence of the helical groove 62 on the exterior surface does not interfere with the ability of the exterior surface 42 to receive the side load 58, it is preferred that the groove 62 be positioned at a distance away from the center line of the side loading region 60 equal to between 0 and 50% of the length of the head region 44 of the piston 28, not including 0%. That is, it is preferred that the distance between the center line of the side loading region 60 and the longitudinal center line of the groove 62 be between 0 and 50%, not including 0%, of the distance between the first 64 and second 66 ends of the head region 44. More preferred is a distance equal to between 2.5 and 10% of that length, inclusively. Particularly preferred is a distance equal to approximately 5.5% of that length. No matter the distance, it is preferred that the distance be constant over the length of the groove 62, as depicted in FIG. 4. Alternatively, the distance may vary over the length of the groove 62. For example, the groove 62 may define a sinuous path, effectively increasing the length of the groove 62.

A large groove 62 maximizes the space available for holding oil. This also maximizes the reduction in overall weight of the piston 28 that is achieved by the use of a groove 62. Therefore, as shown in FIG. 4, it is also preferred that the groove 62 extend along the entire length of the head region 44. That is, it is preferred that the groove 62 extend from the first end 64 the head region 44 to the second end 66 of the head region 44, winding along a helical path. Alternatively, the groove 62 can comprise a shorter path. Essentially any length can be utilized, and the actual length will reflect the need for the movement of gas and oil between the crank chamber 16 and cylinder bore and/or the need for a reduction in overall weight of the piston 28. As these needs increase, the length of the groove 62 should be increased.

It is preferred that the groove 62 comprises a generally U-shaped trough in the exterior surface 42 of the piston 28. The curvature of the U-shaped trough facilitates movement of gas and oil within the groove 62. However, it will be appreciated that the term "groove" encompasses a variety of other shapes and configurations, including, but not limited to, channels, scores, and perforations.

Figure 5:
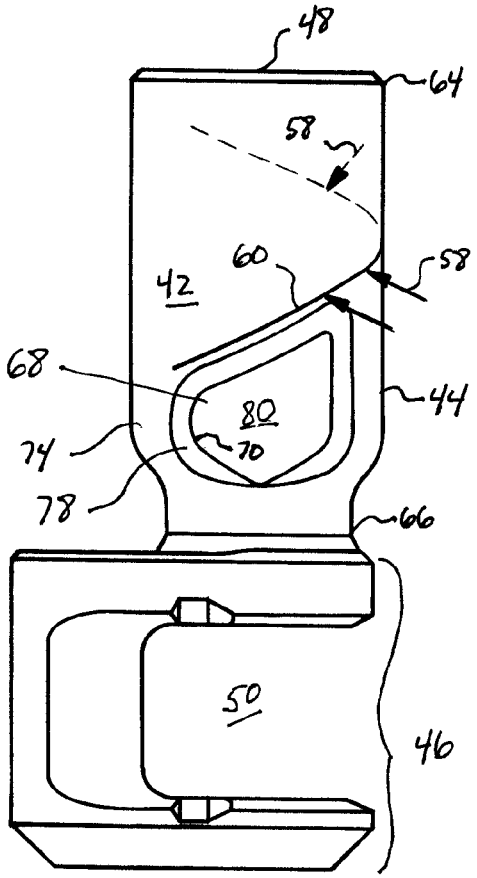
FIG. 5 is an elevational view of a piston incorporating a second preferred embodiment of the present invention.
Figure 6:
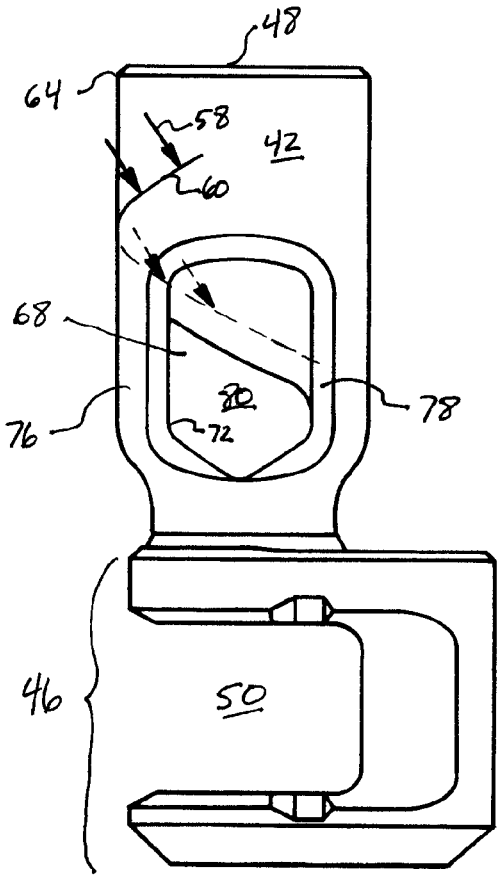
FIG. 6 is a second elevational view of the piston shown in FIG. 5.

FIGS. 5 and 6 illustrate a second preferred embodiment. In this embodiment, at least one recess 68 is located in the head region 44 of the piston 28. The recess 68 preferably has first 70 and second 72 openings positioned on the first 74 and second 76 sides of the piston 28, respectively, and is preferably defined by an edge 78 and a central cavity 80. The recess 68 preferably comprises a void in the head region 44 that spans the entire width of the head region 44. That is, it is preferred that the recess 68 span the distance between the first side 74 of the piston 28 and the second side 76 of the piston 28. Also preferable, the recess 68 has a longitudinal axis that is perpendicular to the longitudinal axis of the piston 28 itself. Alternatively, the recess 68 may be configured in a manner such that its longitudinal axis is angulated with respect to the longitudinal axis of the piston 28, i.e., non-perpendicular.

Figure 7:
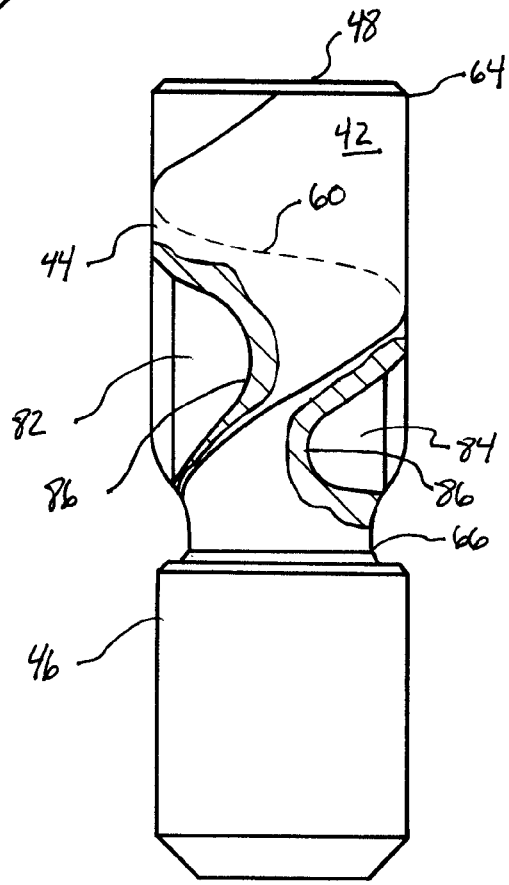
FIG. 7 is a partially broken-away rear view of a third embodiment of a piston incorporating the present invention.

As illustrated in the figures and similar to the embodiment incorporating the helical groove 62, detailed above, it is preferred that the first 70 and second 72 openings of the recess 68 be positioned on the exterior surface 42 of the piston 28 away from the side loading region 60 of the piston 28. Accordingly, as shown in FIGS. 5–7, it is preferred that at least a portion of the edge 78 of both the first 70 and second 72 openings of the recess 68 extend along a path parallel to the side loading region 60. Alternatively, the edges 78 can be positioned at an angle to the side-loading region 60, so long as they do not intersect the region 60.

To ensure that the presence of the recess 68 in the head region 44 does not interfere with the ability of the exterior surface 42 to receive the side load 58, it is preferred that the path of each of the edges 78 be positioned at a distance away from the center line of the side loading region 60 equal to between 0% and 50% of the length of the head region 44. That is, it is preferred that the distance between the center line of the side loading region 60 and the nearest point of each of the edges 78 of the first 70 and second 72 openings of the recess 68 be between 0 and 50%, not including 0%, of the distance between the first 64 and second 66 ends of the head region 44. More preferred is a distance equal to between 1.0 and 20%, inclusively, of that length. Particularly preferred is a distance equal to approximately 12.5% of that length. Therefore, due to the helical nature of the side-loading region 60, the recess 68 preferably comprises a through passageway in the head region 44. At least a portion of the edge 78 defining the first 70 and second 72 opening extends parallel to the side-loading region 60. As a consequence and as illustrated in FIGS. 5 and 6, the first 70 and second 72 openings preferably have differing lengths, and the central cavity 80 is bounded by at least one angulated wall.

In a third preferred embodiment, illustrated in FIG. 7, first 82 and second 84 depressions are present in the head region 44. The depressions 82, 84 of this embodiment are similar to the recess 68 of the embodiment detailed above, except that the first 82 and second 84 depression do no extend through the head region 44 of the piston 28. Rather, the depressions 82, 84 have an inner wall 86 that terminates their travel through the head region 44. In this embodiment, the depressions are preferably semi-circular in shape. Also preferable, the depressions 82, 84 are positioned directly opposite each other, with the first depression 82 located on the first side 74 and the second depression 84 located on the second side 76 of the head region 44. Alternatively, the depressions 82, 84 can take any form and shape and may be positioned in any configuration with respect to each other, so long as neither depression 82, 84 intersects the side loading region 60. Furthermore, the depressions 82, 84 may each have a different shape. For example, the first depression 82 may be semi-circular in shape and the second depression 84 may be elliptical in shape. In all other respects, the depressions 82, 84 are similar to the recess 68 described above.

Pistons 28 incorporating the present invention are preferably comprised of aluminum. Alternatively, the pistons 28 can be fabricated from steel or any other metal, alloy, or other material suitable for use in accordance with the present invention. Also, pistons 28 incorporating the present invention are preferably fabricated by techniques known in the art, such as machining and forging. Alternatively, the pistons 28 can be made by any suitable process.

The foregoing disclosure is the best mode devised by the inventors for practicing the invention. It is apparent, however, that several variations in pistons having grooves and/ or recesses in accordance with the present invention may be conceivable by one skilled in the art. Inasmuch as the foregoing disclosure is intended to enable one skilled in the pertinent art to practice the instant invention, it should not be construed to be limited thereby, but should be construed to include such aforementioned variations. As such, the present invention should be limited only by the spirit and scope of the following claims.

What is claimed is:

1. A piston for use in a swashplate type compressor having a cylinder bore and a crank chamber and being capable of compressing gas containing suspended lubricating oil, said piston comprising:

a head region having first and second ends and first and second sides, a circumferential surface defining a helical groove extending from the first end to the second end, and a length extending from the first end to the second end;

a swashplate engaging region; and a side-loading region on the circumferential surface of the head region, the side-loading region having a center line;

wherein the side-loading region receives a side load generated during operation of said compressor and wherein the helical groove is positioned in a manner such that it does not intersect the center line of the side-loading region.

2. A piston in accordance with claim 1, wherein the void comprises a helical groove.

3. A piston in accordance with claim 2, wherein the helical groove extends from the first end of the head region to the second end of the head region.

4. A piston in accordance with claim 1, wherein the helical groove extends along a path parallel to the center line of the side-loading region.

5. A piston in accordance with claim 4, wherein the helical groove has a longitudinal center line and the distance between the longitudinal center line and the center line of the side loading region is equal to between approximately 0 and 50% of the length of the head region, not including 0%.

6. A piston in accordance with claim 5, wherein the distance is equal to between approximately 2.5 and 10% of the length of the head region.

7. A piston in accordance with claim 5, wherein the distance is equal to approximately 5.5% of the length of the head region.

8. A piston for use in a swashplate type compressor having a cylinder bore and a crank chamber and being capable of compressing gas containing suspended lubricating oil, said piston comprising:

a head region having first and second ends and first and second sides, a circumferential surface defining a void, and a length extending from the first end to the second end;

a swashplate engaging region; and a side-loading region on the circumferential surface of the head region, the side-loading region having a center line;

wherein the side-loading region receives a side load generated during operation of said compressor and wherein the void is positioned in a manner such that it does not intersect the center line of the side-loading region; and wherein the void comprises a recess in the head region, the recess comprising a through passageway having first and second openings defined by first and second edges and located on the first and second sides, respectively, of the head region.

9. A piston in accordance with claim 8, wherein at least a portion of the first and second edges extends along a path parallel to the side loading region.

10. A piston in accordance with claim 8, wherein the distances between the center line of the side loading region and the nearest point of the first and second edges are each equal to between approximately 0 and 50% of the length of the head region, not including 0%.

11. A piston in accordance with claim 10, wherein the distance is equal to between approximately 1.0 and 20% of the length of the head region.

12. A piston in accordance with claim 10, wherein the distance is equal to approximately 12.5% of the length of the head region.

13. A piston for use in a swashplate type compressor having a cylinder bore and a crank chamber and being capable of compressing gas containing suspended lubricating oil, said piston comprising:

a head region having first and second ends and first and second sides, a circumferential surface defining a void, and a length extending from the first end to the second end;

a swashplate engaging region; and a side-loading region on the circumferential surface of the head region, the side-loading region having a center line;

wherein the side-loading region receives a side load generated during operation of said compressor and wherein the void is positioned in a manner such that it does not intersect the center line of the side-loading region; and wherein the void comprises a depression in the circumferential surface of the head region, the depression having an edge located at a distance from the side-loading region.

14. A piston in accordance with claim 13, wherein the depression comprises a semi-circular recess in the exterior surface of the head region.

15. A piston in accordance with claim 13, further comprising a second depression in the circumferential surface of the head region.

16. A piston in accordance with claim 15, wherein the first depression is positioned on the first side of the head region and the second depression is positioned on the second side of the head region.

17. A piston for use in a swashplate type compressor having a cylinder bore and a crank chamber and being capable of compressing gas containing suspended lubricating oil, said piston comprising:

a head region having first and second ends, a circumferential surface, and a length extending from the first end to the second end;

a swashplate engaging region;

a side loading region on the circumferential surface of the head region, the side loading region having a center line; and means for storing said lubricating oil, the means being positioned on the circumferential surface of the head region such that the means do not intersect the center line of the side-loading region;

wherein the side loading region receives a side load generated during operation of said compressor and the means for storing said lubricating oil are adapted to seal a gap between said piston and said cylinder bore.

18. A piston in accordance with claim 17, wherein the means for storing said lubricating oil comprise a helical groove.

19. A piston for use in a swashplate type compressor having a cylinder bore and a crank chamber and being capable of compressing gas containing suspended lubricating oil, said piston comprising:

a head region having first and second ends, a circumferential surface, and a length extending from the first end to the second end;

a swashplate engaging region;

a side loading region on the circumferential surface of the head region, the side loading region having a center line; and means for storing said lubricating oil, the means being positioned on the circumferential surface of the head region such that the means do not intersect the center line of the side-loading region;

wherein the side loading region receives a side load generated during operation of said compressor and the means for storing said lubricating oil are adapted to seal a gap between said piston and said cylinder bore; and wherein the means for storing said lubricating oil comprise a through opening in the head region.

20. A piston for use in a swashplate type compressor having a cylinder bore and a crank chamber and being capable of compressing gas containing suspended lubricating oil, said piston comprising:

a head region having first and second ends, a circumferential surface, and a length extending from the first end to the second end;

a swashplate engaging region;

a side loading region on the circumferential surface of the head region, the side loading region having a center line; and means for storing said lubricating oil, the means being positioned on the circumferential surface of the head region such that the means do not intersect the center line of the side-loading region;

wherein the side loading region receives a side load generated during operation of said compressor and the means for storing said lubricating oil are adapted to seal a gap between said piston and said cylinder bore; and wherein the means for storing said lubricating oil comprise at least one depression in the head region.

21. A piston for use in a swashplate type compressor having a cylinder bore and a crank chamber and being capable of compressing gas containing suspended lubricating oil, said piston comprising:

a head region having first and second ends, a circumferential surface, and a length extending from the first end to the second end;

a swashplate engaging region;

a side loading region on the circumferential surface of the head region, the side loading region having a center line; and a helical groove on the circumferential surface, the groove extending along a line parallel to the center line of the side-loading region and along the length of the head region;

wherein the side-loading region receives a side load generated during operation of said compressor and the helical groove is adapted to store lubricating oil; and wherein the helical groove provides a communicative passageway between said cylinder bore and said crank chamber of said swashplate type compressor.

* * * * *

UNITED STATES PATENT AND TRADEMARK OFFICE

CERTIFICATE OF CORRECTION

PATENT NO. : 6,431,053 B1 
DATED : August 13, 2002
INVENTOR(S) : Guntis V. Strikis et al.

It is certified that error appears in the above-identified patent and that said Letters Patent is hereby corrected as shown below:

Column 5,
Lines 58 and 59, delete claim 2 in its entirety.
Lines 60-63, delete claim 3 in its entirety.
Line 64, renumber claim 4 as claim 2.
Line 66, renumber claim 5 as claim 3; delete “claim 4” and substitute -- claim 2 -- in its place.

Column 6,
Line 4, renumber claim 6 as claim 4; delete “claim 5” and substitute -- claim 3 -- in its place.
Line 7, renumber claim 7 as claim 5; delete “claim 5” and substitute -- claim 3 -- in its place.
Line 10, renumber claim 8 as claim 6.
Line 33, renumber claim 9 as claim 7; delete “claim 8” and substitute -- claim 7 -- in its place.
Line 35, renumber claim 10 as claim 8; delete “claim 8” and substitute -- claim 6 -- in its place.
Line 40, renumber claim 11 as claim 9; delete “claim 10” and substitute -- claim 8 -- in its place.
Line 43, renumber claim 12 as claim 10; delete “claim 10” and substitute -- claim 8 -- in its place.
Line 46, renumber claim 13 as claim 11.

Column 7,
Line 1, renumber claim 14 as claim 12; delete “claim 13” and substitute -- claim 11 -- in its place.
Line 4, renumber claim 15 as claim 13; delete “claim 13” and substitute -- claim 11 -- in its place.
Line 7, renumber claim 16 as claim 14; delete “claim 15” and substitute -- claim 13 -- in its place.
Lines 11-30, delete claim 17 in its entirety.
Lines 31-33, delete claim 18 in its entirety.
Line 34, renumber 19 as claim 15.

UNITED STATES PATENT AND TRADEMARK OFFICE

CERTIFICATE OF CORRECTION

PATENT NO. : 6,431,053 B1 
DATED : August 13, 2002
INVENTOR(S) : Guntis V. Strikis et al.

It is certified that error appears in the above-identified patent and that said Letters Patent is hereby corrected as shown below:

Column 8,
Line 5, renumber claim 20 as claim 16.
Line 28, renumber claim 21 as claim 17.

Signed and Sealed this

Twelfth Day of August, 2003

JAMES E. ROGAN
*Director of the United States Patent and Trademark Office*